US007571836B2

(12) United States Patent
Foster et al.

(10) Patent No.: US 7,571,836 B2
(45) Date of Patent: Aug. 11, 2009

(54) TRIGGER SPRAYER WITH PISTON ROD AND SPRING SNAP CONNECTION

(75) Inventors: Donald D. Foster, St. Charles, MO (US); Philip L. Nelson, Wildwood, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 0 days.

(21) Appl. No.: 11/613,706

(22) Filed: Dec. 20, 2006

(65) Prior Publication Data

US 2007/0210117 A1 Sep. 13, 2007

Related U.S. Application Data

(63) Continuation-in-part of application No. 11/369,351, filed on Mar. 7, 2006, now abandoned.

(51) Int. Cl.
*B65D 88/54* (2006.01)

(52) U.S. Cl. ..... 222/340; 222/383.1; 239/333

(58) Field of Classification Search ..... 222/383.1, 222/340, 341, 336, 136, 381, 382; 239/333, 239/302, 367

See application file for complete search history.

(56) References Cited

U.S. PATENT DOCUMENTS

| | | | | |
|---|---|---|---|---|
| 3,768,734 | A | 10/1973 | Anderson, Jr. et al. | |
| 5,211,315 | A * | 5/1993 | Geier | 222/340 |
| 5,299,717 | A * | 4/1994 | Geier | 222/340 |
| 5,706,984 | A * | 1/1998 | Tada et al. | 222/182 |
| 5,984,149 | A * | 11/1999 | Thanisch et al. | 222/340 |
| 6,116,472 | A | 9/2000 | Wanbaugh et al. | |
| 6,267,271 | B1 * | 7/2001 | Tsuchida et al. | 222/383.1 |
| 6,286,723 | B1 * | 9/2001 | Sweeton et al. | 222/153.13 |
| 7,175,056 | B2 * | 2/2007 | Buti | 222/383.1 |

FOREIGN PATENT DOCUMENTS

| | | | |
|---|---|---|---|
| EP | 0529254 | * | 7/1992 |
| EP | 0529255 | * | 7/1992 |
| EP | 0798050 | * | 10/1997 |
| JP | 10156235 | * | 6/1998 |

* cited by examiner

*Primary Examiner*—Lien T Ngo

(57) ABSTRACT

A manually operated trigger sprayer includes U-shaped springs that bias the trigger sprayer trigger away from the trigger sprayer pump chamber, where the U-shaped springs are connected to a piston rod by a snap-fit connection. The connection includes a compressible forward end of the piston rod that is pressed through an opening on the forward end of the spring to connect the piston rod to the spring. The rearward end of the spring is connected to the sprayer housing by a curved surface that engages around an exterior surface of the pump chamber.

35 Claims, 8 Drawing Sheets

TRIGGER SPRAYER WITH PISTON ROD AND SPRING SNAP CONNECTION

CROSS-REFERENCE TO RELATED APPLICATIONS

This is a continuation-in-part of patent application Ser. No. 11/369,351, filed on Mar. 7, 2006, and currently pending.

BACKGROUND OF THE INVENTION

1. Field of the Invention

The present invention pertains to the construction of a manually operated trigger sprayer in which a U-shaped spring is connected to a piston rod by a snap-fit connection. The connection includes a compressable forward end of the piston rod that is pressed through an opening on the forward end of the spring to connect the piston rod to the spring. The rearward end of the spring is connected to the sprayer housing by a curved surface that engages around an exterior surface of the pump chamber.

2. Description of the Related Art

Handheld and hand pumped liquid dispensers commonly known as trigger sprayers are used to dispense many household products and commercial cleaners. Trigger sprayers have been used to dispense household cleaning or cooking liquids and have been designed to selectively dispense the liquids in a spray, stream, or foaming discharge. The trigger sprayer is typically connected to a plastic bottle that contains the liquid dispensed by the sprayer.

A typical trigger sprayer includes a sprayer housing that is connected to the neck of the bottle by either a thread connection or a bayonet-type connection. The sprayer housing is formed with a pump chamber and a vent chamber, a liquid supply passage that communicates the pump chamber with a liquid inlet opening of the sprayer housing, and a liquid discharge passage that communicates the pump chamber with a liquid outlet opening of the sprayer housing. A dip tube is connected to the sprayer housing liquid inlet opening to communicate the pump chamber with the liquid contents of the bottle connected to the trigger sprayer.

A nozzle assembly is connected to the sprayer housing at the liquid outlet opening. Some nozzle assemblies include a nozzle cap that is rotatable relative to the sprayer housing between an "off" position where liquid discharge from the trigger sprayer is prevented, and one or more "on" positions where liquid discharge from the trigger sprayer is permitted. In addition, known nozzle assemblies can affect the liquid discharged by the trigger sprayer to discharge the liquid in a spray pattern, in a stream pattern, or as a foam.

A pump piston is mounted in the sprayer housing pump chamber for reciprocating movement between charge and discharge positions of the piston relative to the pump chamber. When the pump piston is moved to its charge position, the piston is retracted out of the pump chamber. This creates a vacuum in the pump chamber that draws liquid from the bottle, through the dip tube and into the pump chamber. When the pump piston is moved to its discharge position, the piston is moved into the pump chamber. This exerts a force on the liquid in the pump chamber that pumps the liquid from the pump chamber, through the liquid discharge passage of the sprayer housing and out of the trigger sprayer through the nozzle assembly.

A trigger is mounted on the sprayer housing for movement of the trigger relative to the housing. The trigger is operatively connected to the pump piston to cause the reciprocating movement of the pump piston in the pump chamber in response to movement of the trigger. A user's hand squeezes the trigger toward the sprayer housing to move the trigger and move the pump piston toward the discharge position of the piston in the pump chamber. A metal coil spring is typically positioned inside the pump chamber. The spring engages between the pump piston and a surface of the sprayer housing inside the pump chamber. The spring is compressed when the pump piston is moved to the discharge position in the pump chamber. The resilience of the spring pushes the piston back to the discharge position of the piston relative to the pump chamber when the user's squeezing force on the trigger is released.

Inlet and outlet check valves are assembled into the respective liquid supply passage and liquid discharge passage of the trigger sprayer. The check valves control the flow of liquid from the bottle interior volume through the liquid supply passage and into the pump chamber, and then from the pump chamber and through the liquid discharge passage to the nozzle assembly of the trigger sprayer.

In the construction of the typical trigger sprayer discussed above, all of the component parts are constructed of a plastic material except for the metal coil spring in the pump chamber. If it is desired to recycle the plastic material after the useful life of the trigger sprayer, the coil spring must first be removed. Disassembling the sprayer parts to allow for removal of the coil spring detracts from the value of recycling the plastic of the used trigger sprayer.

Trigger sprayers are at times used to dispense liquids that react with metal. The metal coil spring in the pump chamber could cause a reaction in the liquid pumped through the pump chamber. The reaction of the liquid could detract from a desirable characteristic of the liquid. For example, the reaction could detract from the cleaning ability of a cleaning liquid dispensed by the trigger sprayer.

To overcome the disadvantages associated with the use of a metal coil spring in a trigger sprayer, the spring could be constructed of a plastic material. However, trigger sprayers are at times used to dispense liquids that will react with the plastic of a plastic spring in the pump chamber. The reaction could affect the resilience of the plastic spring. This could detract from the ability of the spring to return the pump piston to the charge position in the pump chamber over the useful life of the trigger sprayer.

SUMMARY OF THE INVENTION

The trigger sprayer of the present invention overcomes disadvantages associated with prior art trigger sprayers by providing the trigger sprayer with an all plastic construction including a plastic spring. In addition, the construction of the trigger sprayer of the invention positions the plastic spring outside of the pump chamber and away from exposure to the liquid dispensed by the trigger sprayer. Still further, the unique construction of the spring of the trigger sprayer and its connection to the piston rod of the trigger sprayer securely holds the spring to the trigger sprayer, where prior art trigger sprayer springs were secured to the trigger sprayer by being contained inside the pump chamber.

The trigger sprayer of the invention has a sprayer housing construction that is similar to that of prior art trigger sprayers. The sprayer housing basically includes an integral cap that attaches to the neck of a separate bottle that contains the liquid to be dispensed by the trigger sprayer. A liquid inlet opening is provided on the sprayer housing inside the cap, and a liquid supply passage extends upwardly through the sprayer housing from the liquid inlet opening.

The sprayer housing also includes a pump chamber having a cylindrical pump chamber wall. The pump chamber communicates with the liquid supply passage.

A liquid discharge passage extends through a liquid discharge tube on the sprayer housing. The liquid discharge passage communicates the pump chamber with a liquid outlet opening on the sprayer housing.

A valve assembly is inserted into the liquid supply passage and separates the liquid supply passage from the liquid discharge passage. The valve assembly includes an input valve that controls the flow of liquid from the sprayer housing inlet opening to the pump chamber, and an output valve that controls the flow of liquid from the pump chamber and through the liquid discharge passage to the liquid outlet opening.

A valve plug assembly is assembled into the liquid supply passage of the sprayer housing. The valve plug assembly includes a valve seat that seats against the input valve, and a vent baffle that defines a vent air flow path through the pump chamber to the interior of the bottle attached to the trigger sprayer.

A nozzle assembly is assembled to the trigger sprayer at the sprayer housing liquid outlet opening. The nozzle assembly is rotatable relative to the trigger sprayer to close the liquid flow path through the liquid discharge passage and the liquid outlet opening, and to open the liquid flow path through the liquid discharge passage and the outlet opening. The nozzle assembly has several open positions relative to the sprayer housing that enable the selective discharge of a liquid in a stream pattern, a spray pattern, and a foaming discharge.

A piston assembly is mounted in the pump chamber for reciprocating movements between charge and discharge positions of the piston assembly relative to the sprayer housing. The piston assembly includes a pump piston and a vent piston, both mounted in the pump chamber. As the pump piston moves to its charge position, the vent piston is moved to a closed position where a venting air flow path through the pump chamber and through the venting air baffle is closed. As the pump piston is moved to its discharge position, the vent piston is moved to an open position in the pump chamber. This opens the venting air flow path through the pump chamber and the venting air baffle to the interior volume of the bottle attached to the trigger sprayer.

A manually operated trigger is mounted on the sprayer housing for pivoting movement. The trigger is engaged by the fingers of a user's hand holding the trigger sprayer. Squeezing the trigger causes the trigger to move toward the pump chamber, and releasing the squeezing force on the trigger allows the trigger to move away from the pump chamber. The trigger is provided with a pair of flanges that engage with the sprayer housing when the trigger is moved to its forward-most position relative to the sprayer housing, preventing further forward movement of the trigger.

The novel construction of the trigger sprayer includes a piston rod that is operatively connected between the trigger and the pump piston. The piston rod has a length with a first, forward end and an opposite second, rearward end. The first, forward end of the piston rod is operatively connected to the trigger. The second, rearward end of the piston rod is operatively connected to the piston assembly. In the preferred embodiment, the piston rod rearward end is formed integrally with the piston assembly. As the piston rod length extends forwardly from the piston assembly, the piston rod length has a necked down portion with a first, circumferential dimension. The piston rod length then extends to an enlarged portion in the form of a knob at the forward end of the piston rod. The knob at the forward end has a second circumferential dimension that is larger than the first circumferential dimension of the necked down section. The forward knob of the piston rod is also compressible. In the preferred embodiment, a vertical groove is formed into the first end of the piston rod to enable compression of the first end.

The metal coil spring contained in the pump chamber of a conventional trigger sprayer is replaced in the novel construction of the trigger sprayer of the invention. The metal spring is replaced by a plastic spring that is assembled to the trigger sprayer outside of the pump chamber. The plastic spring has a curved or bent length with opposite forward and rearward ends. The rearward end of the spring has a curved bar. The curved bar presents a curved surface that engages across a portion of the cylindrical exterior surface of the pump chamber in assembling the spring to the trigger sprayer. From the spring rearward end the spring length has two portions that extend side-by-side over the pump chamber exterior surface and then through inverted U-shaped bends. The forward ends of the bent portions of the springs are connected together by a front panel at the forward ends of the springs. The front panel has an opening through the panel. The piston rod forward end extends through the panel opening. This operatively connects the pair of springs to the piston rod and the piston assembly for biasing the piston rod and piston assembly in a forward direction to the charge position of the piston assembly in the pump chamber. The bias of the pair of springs also urges the trigger toward a forward position of the trigger relative to the trigger sprayer.

The U-shaped configurations of the springs bias the piston rod away from the pump chamber. This biases the piston assembly toward its charge position relative to the pump chamber and the sprayer housing. By manually squeezing the trigger of the trigger sprayer, the forward ends of the springs are moved toward the rearward ends of the springs, narrowing the U-shaped configurations of the springs. When the squeezing force on the trigger is removed, the resiliency of the springs pushes the trigger away from the pump chamber and moves the pump piston back to its charge position relative to the pump chamber.

DESCRIPTION OF THE DRAWING FIGURES

Further features of the invention are set forth in the following detailed description of the preferred embodiment of the invention and in the drawing figures.

DETAILED DESCRIPTION OF THE PREFERRED EMBODIMENT

Figure 1:
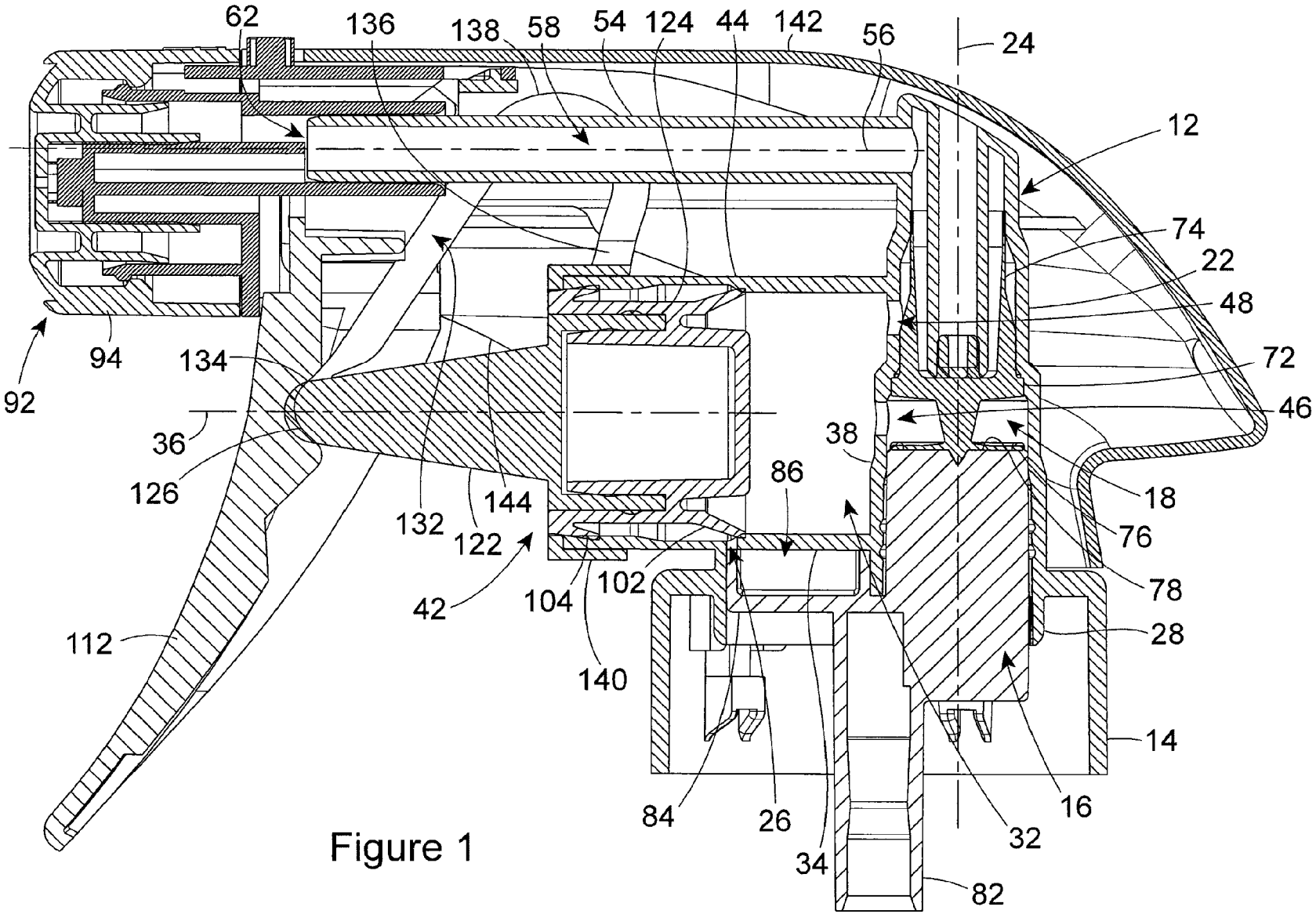
FIG. 1 is a side sectioned view of the trigger sprayer of the invention with the trigger in a forward position relative to the sprayer housing.
Figure 2:
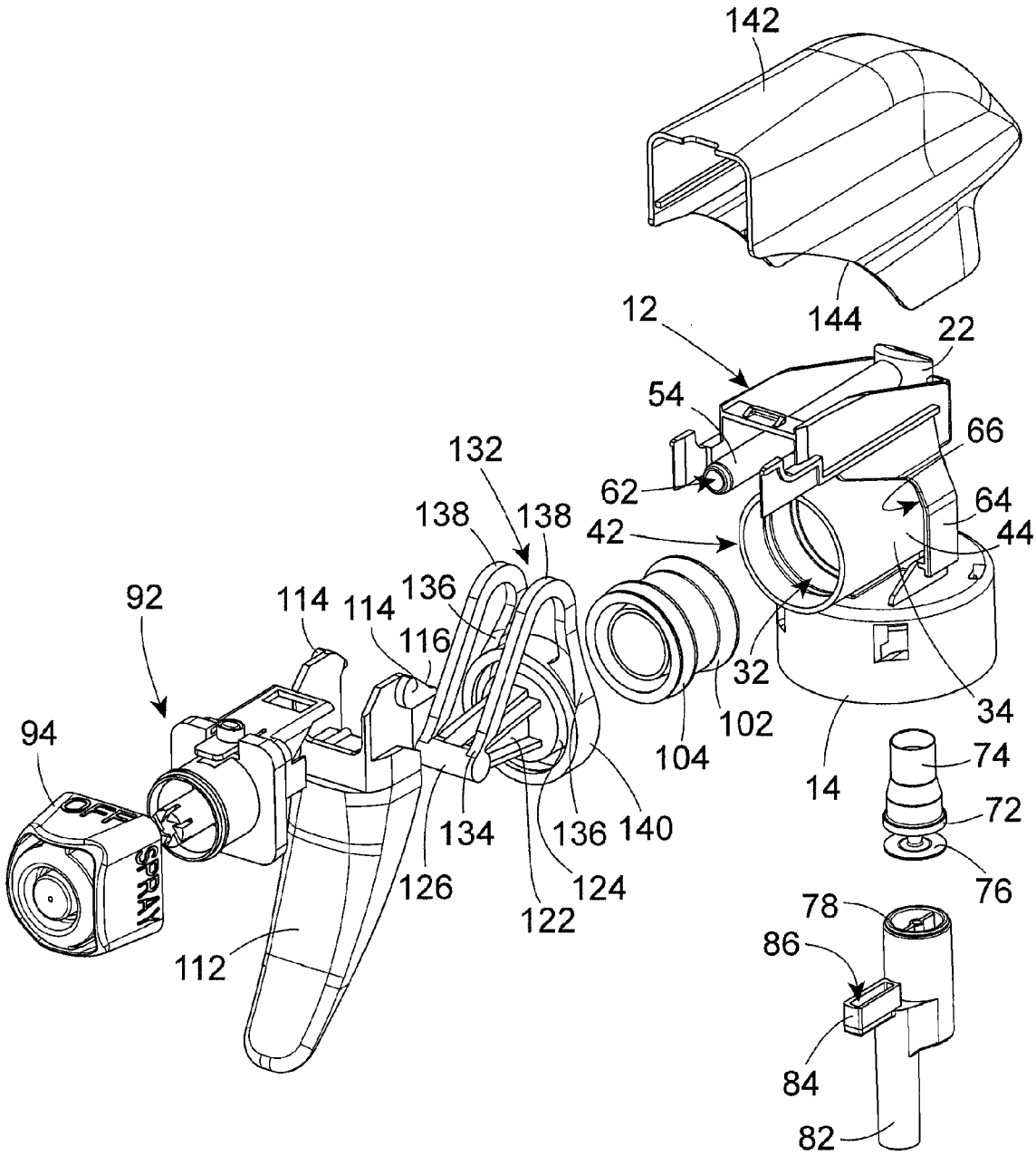
FIG. 2 is a perspective view of the disassembled component parts of the trigger sprayer.
Figure 3:
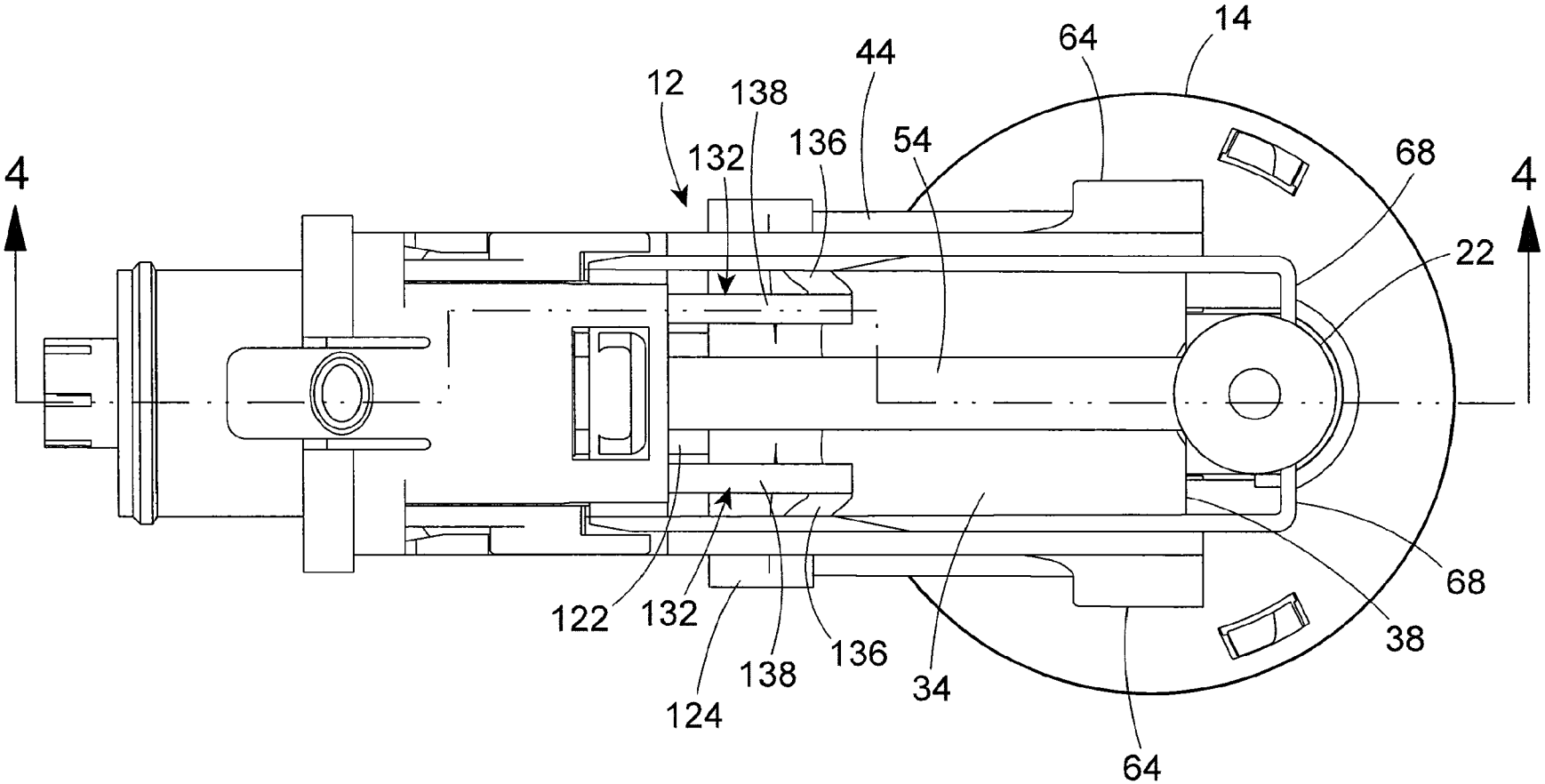
FIG. 3 is a top view of the trigger sprayer with the shroud removed.
Figure 4:
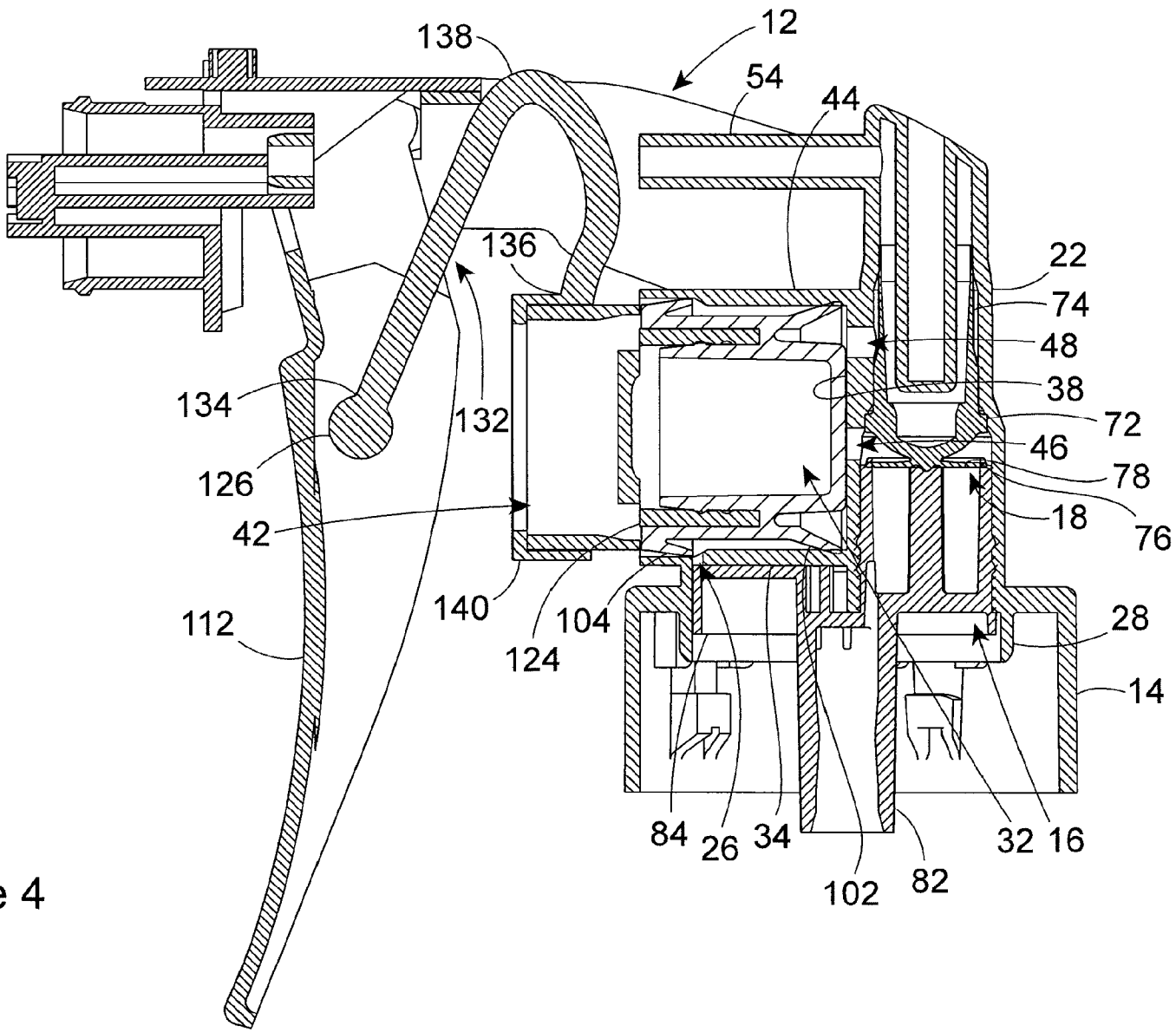
FIG. 4 is a side sectioned view of the trigger sprayer along the line 4-4 of FIG. 3 and with the trigger in a rearward position relative to the sprayer housing.
Figure 5:
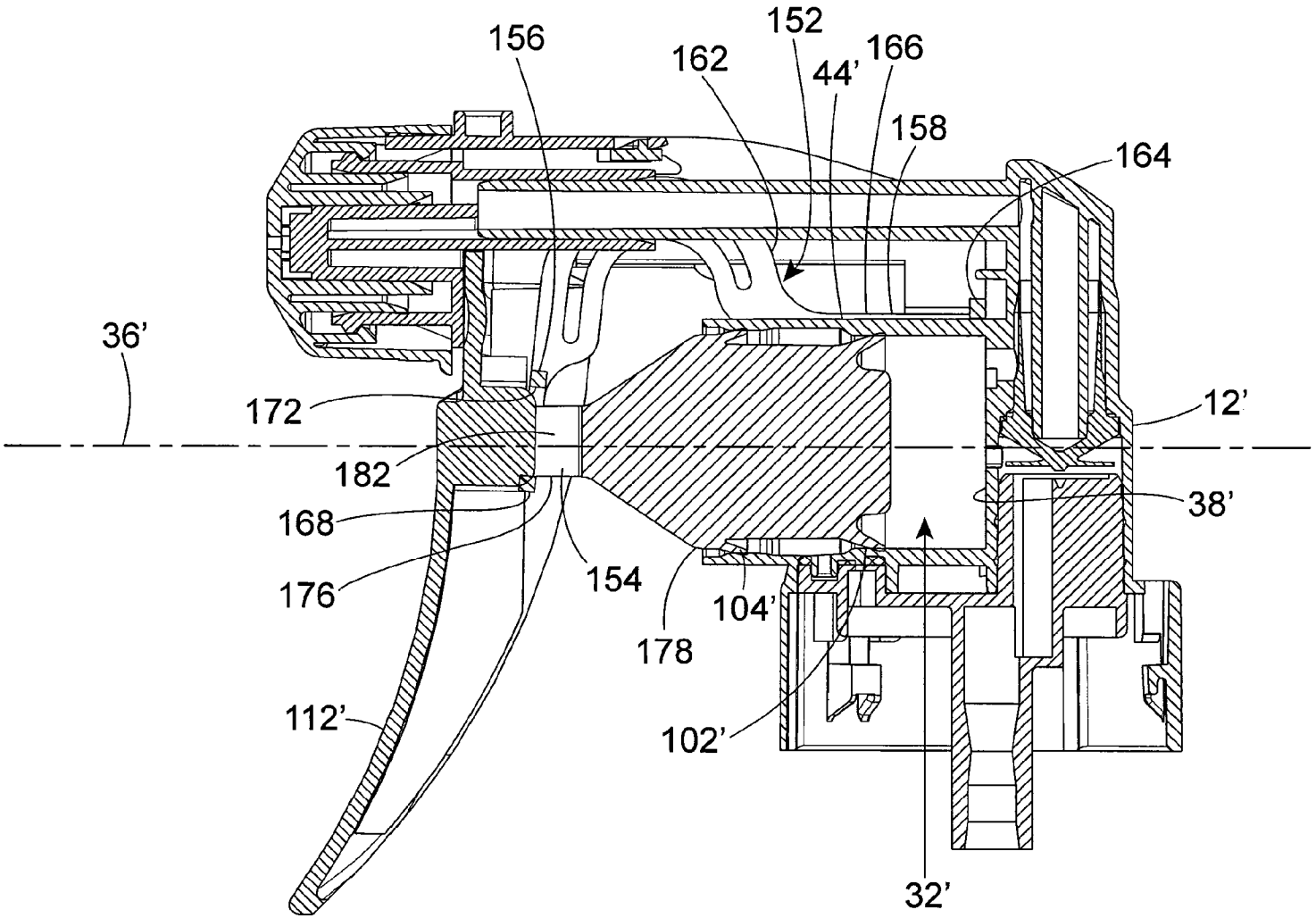
FIG. 5 is a side sectioned view of a further embodiment of the trigger sprayer of the invention that employs a different trigger, spring, and piston rod construction from those of the previously described embodiment.

The novel design of the trigger sprayer of the present invention replaces the metal coil spring of a conventional trigger sprayer with a plastic spring. This enables all of the component parts of the trigger sprayer to be constructed of a plastic material. Furthermore, the novel construction of the trigger sprayer positions the plastic spring outside of the pump chamber. With this positioning of the plastic spring, the operation of the spring cannot be influenced by the liquid pumped by the trigger sprayer.

Several component parts of the trigger sprayer are found in the typical construction of a trigger sprayer, and therefore these component parts are described only generally herein. It should be understood that although the component parts are shown in the drawing figures and are described as having a certain construction, other equivalent constructions of the component parts are known. These other equivalent constructions of trigger sprayer component parts are equally well suited for use with the novel features of the invention to be described herein.

The trigger sprayer includes a sprayer housing 12 that is formed integrally with a connector cap 14. The connector cap 14 removably attaches the trigger sprayer to the neck of a bottle containing the liquid to be dispensed by the trigger sprayer. The connector cap 14 shown in the drawing figures has a bayonet-type connector on its interior. Other types of equivalent connectors may be employed in attaching the trigger sprayer to a bottle. A liquid inlet opening 16 is provided on the sprayer housing 12 in the interior of the connector cap 14. The inlet opening 16 provides access to a liquid supply passage 18 that extends upwardly through a cylindrical liquid column 22 formed in the sprayer housing 12. The column 22 has a center axis 24 that is also the center axis of the liquid supply passage 18. An air vent opening 26 is also provided on the sprayer housing 12 in the interior of the connector cap 14. A cylindrical sealing rim 28 projects outwardly from the connector cap interior and extends around the liquid inlet opening 16 and the vent opening 26. The rim 28 engages inside the neck of a bottle connected to the trigger sprayer to seal the connection.

The sprayer housing includes a pump chamber 32 contained inside a cylindrical pump chamber wall 34 on the sprayer housing 12. The pump chamber cylindrical wall 34 has a center axis 36 that is perpendicular to the liquid supply passage center axis 24. The pump chamber center axis 36 defines mutually perpendicular axial and radial directions relative to the trigger sprayer. A cylindrical interior surface of the pump chamber wall 34 has a smaller interior diameter section adjacent a rear wall 38 of the pump chamber, and a larger interior diameter section adjacent an end opening 42 of the pump chamber. The pump chamber also has a cylindrical exterior surface 44. The smaller interior diameter portion of the pump chamber 32 interior surface functions as the liquid pump chamber, and the larger interior diameter portion of the pump chamber 32 functions as a portion of a venting air flow path through the sprayer housing 12. The vent opening 26 in the sprayer housing connector cap 14 communicates the interior of the larger interior diameter portion of the pump chamber 32 with a bottle connected to the trigger sprayer. A pair of openings 46, 48 pass through the pump chamber rear wall 38 and communicate the interior of the pump chamber with the liquid supply passage 18. The first of the openings 46 is the liquid input opening to the pump chamber 32, and the second of the openings 48 is the liquid output opening from the pump chamber.

A liquid discharge tube 52 is also formed on the sprayer housing 12. The liquid discharge tube is cylindrical and has a center axis 54 that is parallel with the pump chamber center axis 36. The liquid discharge tube 52 defines the liquid discharge passage 58 of the sprayer housing. One end of the liquid discharge passage 58 communicates with the liquid supply passage 18 in the liquid column 22, and the opposite end of the liquid discharge passage 58 exits the sprayer housing 12 through a liquid outlet opening 62 on the sprayer housing.

The sprayer housing 12 is also formed with a pair of exterior side walls or side panels 64 that extend over opposite sides of the pump chamber wall 34 and over opposite sides of the discharge tube 54. The side walls 64 extend over the pump chamber wall 34 in the area of the pump chamber rear wall 38, but do not extend in the forward direction the full extent of the pump chamber wall 34 to the end opening 42. The side walls 64 are spaced outwardly from the pump chamber wall 34 and the discharge tube 54 forming voids 66 between the side wall 64 and the pump chamber wall 34 and the discharge tube 54. The side walls 64 have lengths on the opposite sides of the liquid discharge tube 54 that extend substantially the entire length of the discharge tube. Rear walls 68 of the sprayer housing 12 extend outwardly from opposite sides of the liquid column 22 and connect to the rearward edges of the side walls 64.

A valve assembly comprising an intermediate plug 72, a resilient sleeve valve 74 and a resilient disk valve 76 is assembled into the liquid supply passage 18. The valve assembly is inserted through the liquid inlet opening 16 and the valve assembly plug 72 seats tightly in the liquid supply passage 18 between the pump chamber input opening 46 and the pump chamber output opening 48. Thus, the plug 72 separates the liquid inlet opening 16 into the pump chamber 32 from the liquid outlet opening 62 from the pump chamber 32. The disk valve 76 is positioned in the liquid supply passage 18 to control the flow of liquid from the liquid inlet opening 16 into the pump chamber 32, and to prevent the reverse flow of liquid. The sleeve valve 74 is positioned to control the flow of liquid from the pump chamber 32 and through the liquid discharge passage 58 and the liquid outlet opening 62, and to prevent the reverse flow of liquid.

A valve plug assembly comprising a valve seat 78, a dip tube connector 82, and an air vent baffle 84 is assembled into the liquid inlet opening 16 inside the connector cap 14. The valve seat 78 is cylindrical and seats against the outer perimeter of the valve assembly disk valve 76. A hollow interior bore of the valve seat 78 allows liquid to flow through the bore and unseat the disk valve 76 from the seat 78 as the liquid flows from the inlet opening 16 to the pump chamber 32. The periphery of the disk valve 76 seats against the valve seat 78 to prevent the reverse flow of liquid. The dip tube connector 82 is a cylindrical connector at the center of the plug assembly that connects to a separate dip tube (not shown). The valve plug assembly positions the dip tube connector 82 so that it is centered in the connector cap 14 of the sprayer housing. The air vent baffle 84 covers over but is spaced from the vent opening 26 in the connector cap 14. The baffle 84 has a baffle opening 86 that is not aligned with the vent opening 26, but communicates with the vent opening through the spacing between the air vent baffle 84 and the interior surface of the connector cap 14. This allows air to pass through the vent opening 26 and through the baffle spacing and the baffle opening 86 to vent the interior of the bottle connected to the trigger sprayer to the exterior environment of the sprayer. Because the vent opening 26 and baffle opening 86 are not directly aligned, the air vent baffle 84 prevents liquid in the bottle from inadvertently passing through the baffle opening 86, the baffle spacing and the vent opening 26 to the exterior of the trigger sprayer should the trigger sprayer and bottle be inverted or positioned on their sides.

A nozzle assembly 92 is assembled to the sprayer housing 12 at the liquid outlet opening 62. The nozzle assembly 92 can have the construction of any conventional known nozzle assembly that produces the desired discharge pattern of liquid from the trigger sprayer. In the preferred embodiment of the invention, the nozzle assembly 92 has a rotatable nozzle cap 94 that selectively changes the discharge from a "off" condition where the discharge is prevented, to a "spray" condition, a "stream" condition and/or a foaming discharge.

A piston assembly comprising a liquid pump piston 102 and a vent piston 104 is mounted in the pump chamber 32 for reciprocating movement along the pump chamber axis 36. The pump piston 102 reciprocates between a charge position and a discharge position in the pump chamber 32. In the charge position, the pump piston 102 moves in a forward direction away from the pump chamber rear wall 38. This expands the interior of the pump chamber creating a vacuum in the chamber that draws liquid into the pump chamber, as is conventional. In the discharge position, the pump piston 102 moves in an opposite rearward direction into the pump chamber toward the pump chamber rear wall 38. This exerts a force on the liquid drawn into the pump chamber 32 and forces the liquid through the output opening 48, past the sleeve valve 74 and through the liquid discharge passage 58 and the liquid outlet opening 62. As the pump piston 102 reciprocates in the pump chamber 32 between the charge and discharge positions, the vent piston 104 reciprocates between a vent closed position where the vent piston 102 engages against the interior surface of the pump chamber wall 34, and a vent open position where the vent piston 104 is spaced inwardly from the interior of the pump chamber wall 34. In the vent open position of the vent piston 104, air from the exterior environment of the sprayer can pass through the pump chamber opening 42, past the vent piston 104 to the vent opening 26, and then through the spacing between the baffle 84 and the connector cap 14, through the vent baffle opening 86 and to the interior of the bottle connected to the trigger sprayer.

A manually operated trigger 112 is mounted on the sprayer housing 12 for opposite forward and rearward movement of the trigger relative to the sprayer housing. The trigger 112 has a pair of pivot posts 114 that project from opposite sides of the trigger and mount the trigger to the sprayer housing 12 for pivoting movement. A pair of flanges 116 project outwardly from the pivot posts 114 and limit the forward pivoting movement of the trigger 112 away from the sprayer housing 12. The construction of the trigger includes a finger engagement surface that is engaged by the fingers of a user's hand. Squeezing the trigger causes the trigger to pivot rearwardly toward the pump chamber 32, and releasing the squeezing force on the trigger allows the trigger to pivot forwardly away from the pump chamber. The engagement of the trigger flanges 116 with the sprayer housing side panels 64 stops the forward movement of the trigger 112.

The trigger sprayer of FIGS. 1-4 includes a piston rod 122 that is operatively connected between the trigger 112 and the pump piston 102 and vent piston 104. The piston rod 122 has a length with a annular collar or ring 124 at one end of the rod length. The ring 124 is assembled to the piston assembly pump piston 102 and vent piston 104. The opposite end 126 of the piston rod 122 engages with and is operatively connected to the trigger 112.

The construction of the trigger sprayer also includes a pair of springs 132 that are formed integrally with the piston rod 122 and the ring 124. Together the springs 132, the piston rod 122, and the ring 124 are one, monolithic piece of plastic material, thereby reducing the number of separate component parts that go into the construction of the trigger sprayer. The pair of springs 132 each have a narrow, elongate length that extends between opposite proximal 134 and distal 136 ends of the springs. The intermediate portions 138 of the springs between the proximal ends 134 and distal ends 136 have the same bent or inverted U-shaped configurations. The spring proximal ends 134 are connected to the piston rod 122 at the first end or forward end 126 of the piston rod. From the proximal ends 134, the lengths of the springs angle upwardly away from the piston rod 22 and the pump chamber center axis 36 and then extend through the intermediate portions 138 of the springs. As the lengths of the springs extend through their U-shaped intermediate portions 138, the springs extend along opposite sides of the liquid discharge tube 54 and over the pump chamber wall 34. The springs then extend downwardly toward the pump chamber center axis 36 as the springs extend to their distal ends 136. The spring distal ends 136 are integrally connected to a circular collar or ring 140. The ring 140 is attached around the pump chamber 32 at the end opening 42 and thereby connects the spring distal ends 136 to the sprayer housing 12.

The inverted, U-shaped configurations of the springs 132 bias the piston rod 122 and the connected pump piston 102 and vent piston 104 outwardly away from the pump chamber rear wall 38. This biases the pump piston 102 toward its charge position relative to the pump chamber 32 and the sprayer housing 12. By manually squeezing the trigger 112, the spring proximal ends 134 move toward the spring distal ends 136, narrowing the U-shaped bend in the intermediate portions 138 of the springs. When the squeezing force on the trigger 112 is removed, the resiliency of the springs pushes the trigger 112 away from the pump chamber rear wall 38 and moves the pump piston 102 back to its charge position relative to the pump chamber 32.

A shroud 142 is attached over the sprayer housing 12 to provide an aesthetically pleasing appearance to the trigger sprayer. The shroud 142 has a lower edge 144 that is positioned below the U-shaped bends in the pair of springs 132. Thus, the shroud 142 protects the springs 132 from contact with portions of the hand or other objects exterior to the trigger sprayer when the trigger sprayer is being operated.

By providing the U-shaped springs 132 as an integral part of the pump piston rod 122 in lieu of the conventional coiled metal spring positioned in the pump chamber, the component parts of the trigger sprayer are reduced. This results in reduced manufacturing costs for the trigger sprayer.

In addition, by providing the pair of springs 132 as an integral part of the pump piston rod 122 and the ring 140, the springs are constructed of the same piece of material as the pump piston rod and ring. This eliminates the need for a separate metal coil spring and enables all of the component parts of the trigger sprayer to be constructed of a plastic material. With all the sprayer parts being constructed of plastic, the trigger sprayer can be recycled more economically after use.

FIGS. 5-8 show a further embodiment of the trigger sprayer of the invention. In the embodiment of FIGS. 5-8, many of the component parts of the trigger sprayer are the same or are substantially the same as those present in the construction of the previously described embodiment of FIGS. 1-4. These structural components that are the same or substantially the same as those of the previously described embodiment are labeled by the same reference numbers used in labeling the component parts of the previously described embodiment, but the reference numbers are followed by a prime (').Because these component parts are the same or substantially the same as the previously described embodiment, their structure and function will not be described again.

In the embodiment of FIGS. 5-8, the constructions of the spring assembly 152 and piston rod 154 differ from those of the previously described embodiment. As in the previously described embodiment, the spring assembly 52 is positioned outside of the pump chamber and is connected to the piston rod 154. However, the spring assembly 152 is a separate component part from that of the piston rod 154. Both the spring assembly 152 and the piston rod 154 are constructed of plastic.

Figure 6:
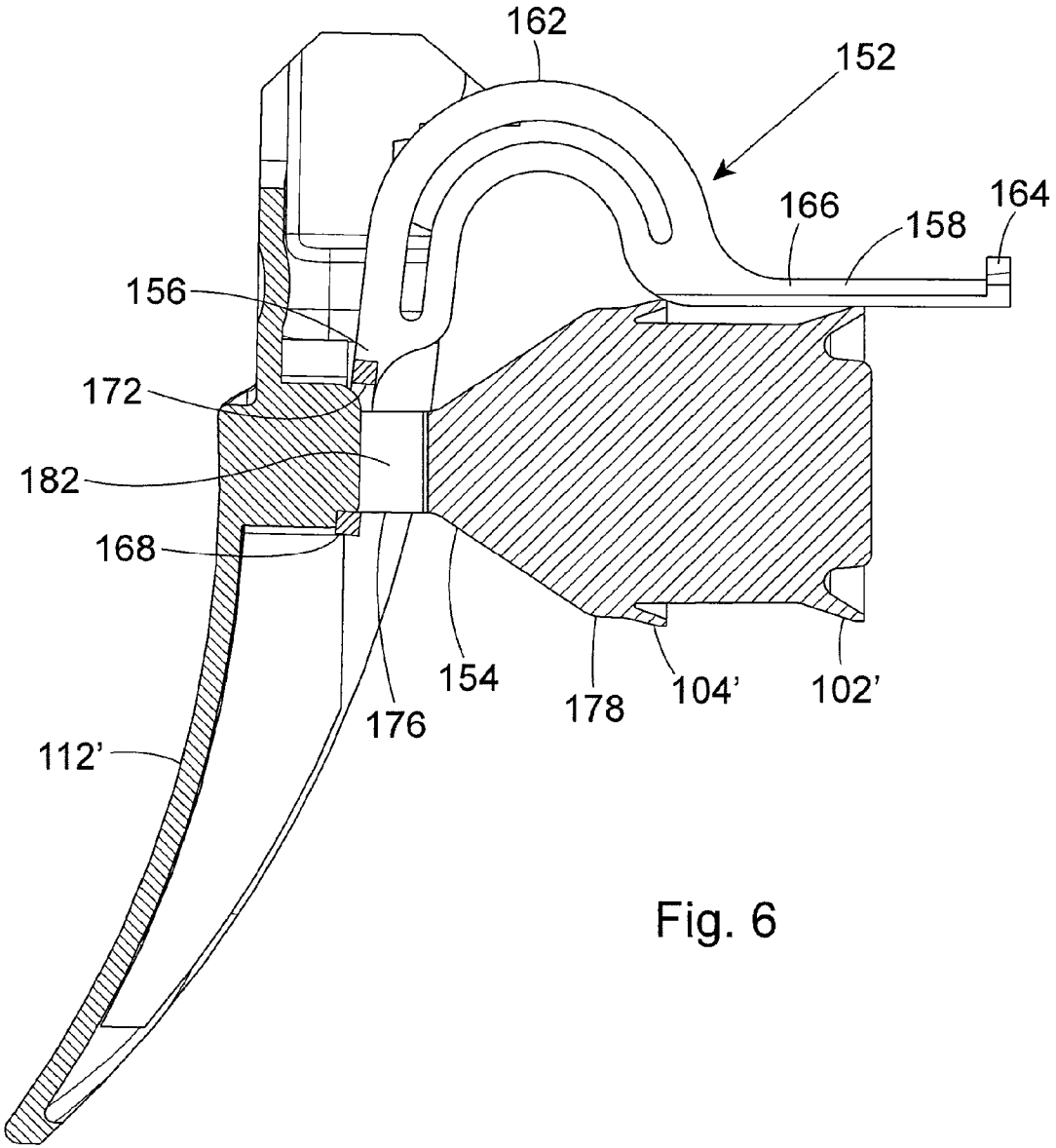
FIG. 6 is a side sectioned view of the trigger, spring, and piston rod removed from the sprayer housing of FIG. 5.
Figure 7:
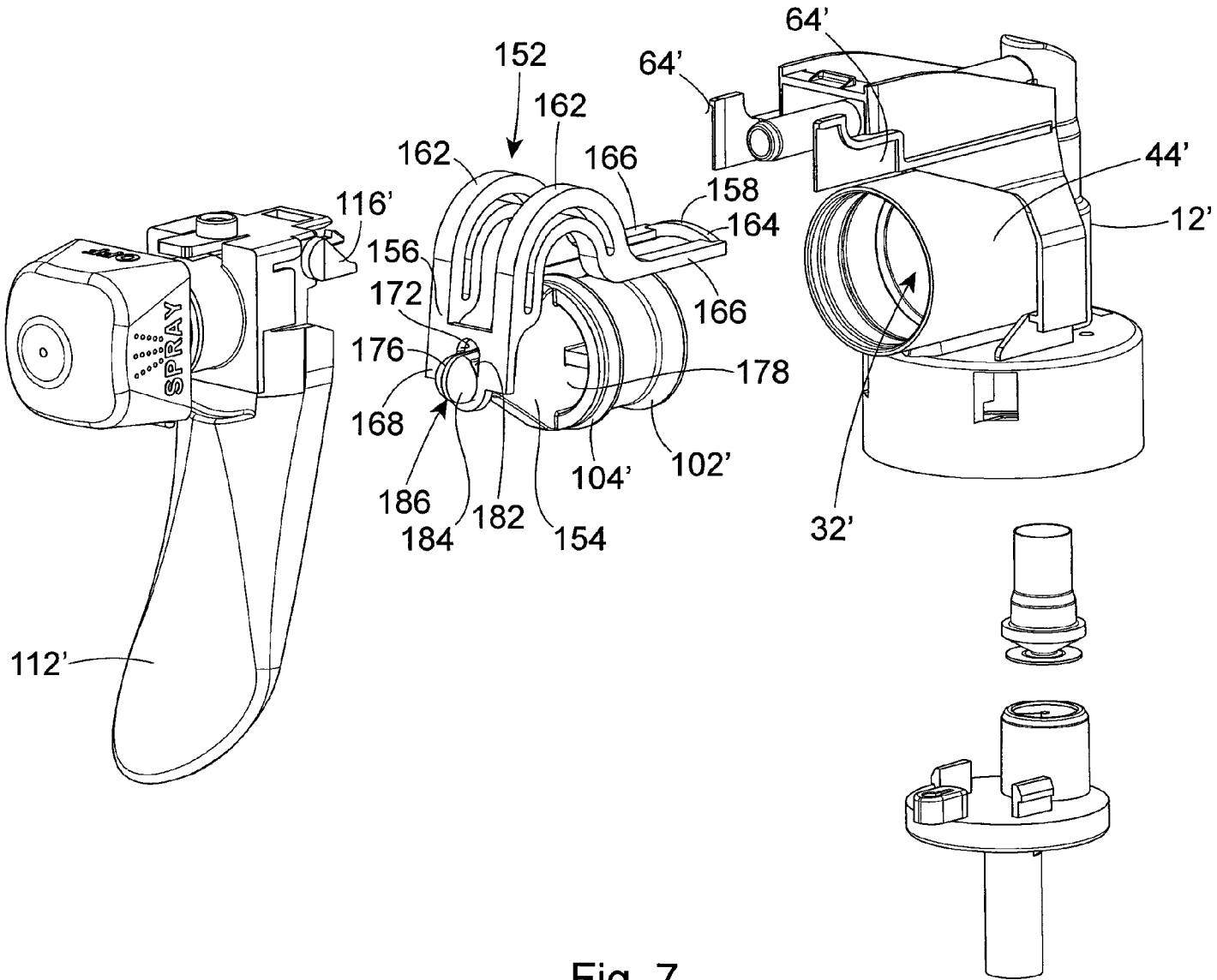
FIG. 7 is a perspective view of the component parts of the trigger sprayer of FIG. 5 disassembled.
Figure 8:
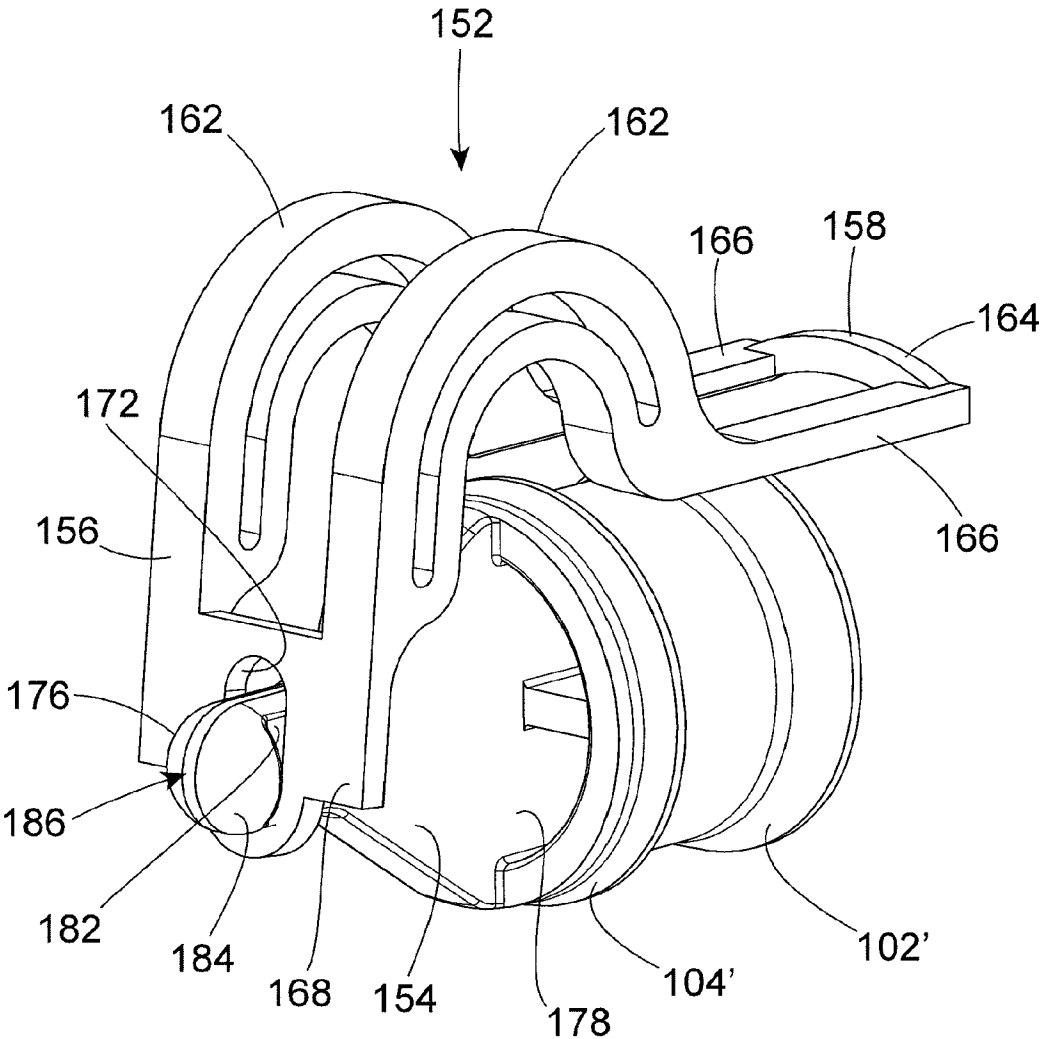
FIG. 8 is a perspective view of the spring and piston rod of FIG. 5.

The spring assembly 152 is shown disassembled from the trigger sprayer in FIGS. 6, 7, and 8. The spring assembly 152 has a general curved or bent length that extends from a forward end 156 of the spring assembly to a rearward end 158 of the spring assembly. As in the previously described embodiment of the trigger sprayer, an intermediate portion of the spring assembly length is formed as a pair of curved or bent springs 162. These springs 162 have the general inverted U-shaped configuration of the previously describe embodiment. However, the springs 162 differ from that of the previously described embodiment in that they each are formed as a pair of curved leaves that are separate from each other. In alternate embodiments, the springs 162 could be formed as a pair of single leaf springs as in the previously described embodiment. Still further, the pair of springs 162 could be replaced by a single spring that extends along the curved length of the spring assembly 152.

The rearward ends 158 of the springs are joined to a curved bar 164. The curvature of the bar 164 is determined so that a bottom or radially inward surface of the curved bar 164 engages around a portion of the cylindrical exterior surface 44' of the pump chamber. This curved bar 164 wedges between the exterior surface of the pump chamber 44' and the pair of side walls 64' of the sprayer housing in assembling the spring assembly 152 to the sprayer housing. From opposite ends of the curved bar 164, the spring assembly 152 includes a pair of parallel straight bars 166 that extend axially across the pump chamber exterior surface 44' to the bent portions of the springs 162. The axial bars 166 engaging across the pump chamber exterior surface 44' further stabilize the spring assembly 152 relative to the sprayer housing. From the ends of the axial bars 166 opposite the curved bar 164, the bent springs 162 first extend away from the pump chamber 32' and then curve and extend downwardly to the spring forward end 156 positioned in front of the pump chamber. The spring forward end 156 is formed as a substantially flat panel that joins together the forward ends of the two bent portions of the springs 162. An opening 172 is provided in the panel 168. In the preferred embodiment, the opening 172 is a hole that passes completely through the front panel 168 and is centered relative to the pump chamber axis 36'. Still further, as shown in the drawing figures, the preferred configuration of the opening hole 172 is an oblong slot that is positioned vertically on the front panel 168.

The piston rod 154 has an axial length that extends between a forward end 176 and a rearward end 178 of the rod. In the illustrated embodiment, the piston rod rearward end 178 is formed integrally with the pump piston 102' and the vent piston 104'. In alternate embodiments, the piston rod rearward end 178 could be assembled to the pump piston and vent piston as described in the previous embodiment. From the rearward end 178, the piston rod extends axially forward to the piston rod forward end 176. As the piston rod 154 extends forward, the rod length extends through a necked down portion 182 of the rod. The necked down portion 182 of the piston rod has a first circumferential dimension around the portion. The first circumferential dimension of the necked down portion 182, allows this portion of the piston rod to extend into the spring front panel opening 172. As shown in the drawing figures, the piston rod necked down portion 182 extends completely through the front panel opening 172 to the opposite side of the spring forward end 156 from the pump piston 102' and vent piston 104'. Also as shown in the drawing figures, the relative dimensions of the piston rod necked down portion 182 and the oblong opening 172 in the spring forward end 156 allow the piston rod necked down portion 182 to slide through the elongated slot of the spring forward end opening 172 on flexing movement of the spring assembly 152. Extending forwardly along the length of the piston rod 154 from the necked down portion 182, the piston rod is provided with an enlarged portion or a knob 184 at the piston rod forward end 176. The knob 184 has a second circumferential dimension that is larger than the first circumferential dimension of the necked down portion 182. The second circumferential dimension of the knob 184 is larger than the width dimension of the oblong opening 172 in the spring forward end 156. This securely holds the spring forward end 156 to the piston rod forward end 176. The piston rod forward end 176 is provided with a vertical groove 186 that extends into the forward end. The groove 186 in the piston rod forward end 176 is provided to make the piston rod forward end compressible. This enables the compression of the piston rod forward end 176 when inserting the forward end through the opening 172 in the spring forward end 156. Once the knob 154 of the piston rod forward end 176 is inserted through the spring opening 172, the resilience of the plastic material of the piston rod 154 allows the knob 184 to expand in width to a larger width dimension than the opening 172 in the spring forward end 156. This secures the spring forward end 156 to the piston rod forward end 176 with the piston rod forward end 176 extending beyond the spring front panel 168 and operatively engaging with the trigger 112'.

The inverted, U-shaped configurations of the bent portions 162 of the springs 152 bias the piston rod 154 and the connected pump piston 102' and vent piston 104' outwardly away from the pump chamber rear wall 38'. This biases the pump piston 102' toward its charge position relative to the pump chamber 32' and the sprayer housing 12'. The bias of the spring assembly 152 is slightly compressed between the engagement of the spring rearward end 158 with the sprayer housing 12' and the engagement of the spring forward end 156 with the trigger 112'. This further secures the spring assembly 152 in place on the trigger sprayer. By manually squeezing the trigger 112', the spring forward end 156 is moved toward the spring rearward end 158, narrowing the U-shaped bends 162 in the springs. When the squeezing force on the trigger 112 is removed, the resiliency of the spring assembly 152 pushes the trigger 112' away from the pump chamber rear wall 38' and moves the pump piston 102' back to its charge position relative to the pump chamber 32'. As the length of the spring assembly 152 is shortened and lengthened as the trigger 112' is manipulated, the oblong opening 172 through the spring forward end 156 allows the piston rod forward end 176 to slide relative to the spring.

The novel constructions of the spring assembly 152 and the piston rod 154 allow the replacement of a conventional metal coil spring in a trigger sprayer with a plastic spring that functions in the same manner as a metal spring, and also allow the plastic spring to be securely assembled to the exterior of the trigger sprayer pump chamber.

Although the trigger sprayer of the invention has been described above by reference to specific embodiments, it should be understood that modifications and variations could be made to the trigger sprayer without departing from the intended scope of the following claims.

The invention claimed is:

1. A manually operated trigger sprayer comprising:

a sprayer housing having a pump chamber in the sprayer housing, a liquid inlet opening on the sprayer housing, a liquid supply passage extending through the sprayer housing communicating the liquid inlet opening with the pump chamber, a liquid outlet opening on the sprayer housing, and a liquid discharge passage extending through the sprayer housing communicating the liquid outlet opening with the pump chamber;

a pump piston mounted in the pump chamber for reciprocating movement between charge and discharge positions of the pump piston in the pump chamber;

a trigger mounted on the sprayer housing for movement of the trigger relative to the sprayer housing;

a spring having a curved length with opposite rearward and forward ends, the spring rearward end being operatively connected to the sprayer housing outside the pump chamber and the spring forward end having an opening, and;

a piston rod projecting from the pump piston and into the spring opening.

2. The trigger sprayer of claim 1, further comprising:

the piston rod has a length with opposite rearward and forward ends, the piston rod forward end is separate from the spring and is connected to the spring by projecting into the spring opening.

3. The trigger sprayer of claim 2, further comprising:

the piston rod rearward end is integral with the pump piston.

4. The trigger sprayer of claim 2, further comprising:

the piston rod forward end projects through the spring opening.

5. The trigger sprayer of claim 4, further comprising:

the piston rod forward end engages with the trigger.

6. The trigger sprayer of claim 4, further comprising:

the spring opening being a hole that extends through the spring forward end; and, the piston rod forward end extending through the spring hole.

7. The trigger sprayer of claim 6, further comprising:

the piston rod forward end engaging with the trigger.

8. The trigger sprayer of claim 4, further comprising:

the piston rod forward end having a necked down portion that extends through the spring opening and having an enlarged portion with a circumference that is larger than a circumference of the necked down portion, the enlarged portion being positioned on an opposite side of the spring opening from the pump piston.

9. The trigger sprayer of claim 4, further comprising:

the piston rod forward end being compressible to enable insertion of the piston rod forward end through the spring opening.

10. The trigger sprayer of claim 9, further comprising:

the piston rod forward end having a groove that extends into the piston rod forward end and enables the piston rod forward end to compress as the piston rod forward end is inserted through the spring opening.

11. The trigger sprayer of claim 1, further comprising:

the pump chamber having cylindrical interior and exterior surfaces and a center axis that defines mutually perpendicular axial and radial directions; and, the spring rearward end extending over the pump chamber exterior surface.

12. The trigger sprayer of claim 11, further comprising:

the spring length having a bent portion between the spring rearward and forward ends, and the spring rearward end engaging with the pump chamber exterior surface positions the spring bent portion between the pump chamber and the trigger.

13. The trigger sprayer of claim 11, further comprising:

the spring rearward end having an axial bar that extends axially over the pump chamber exterior surface.

14. The trigger sprayer of claim 11, further comprising:

the spring rearward end having a curved bar that extends around a portion of the pump chamber exterior surface.

15. A manually operated trigger sprayer comprising:

a sprayer housing having a pump chamber in the sprayer housing, a liquid inlet opening on the sprayer housing, a liquid supply passage extending through the sprayer housing communicating the liquid inlet opening with the pump chamber, a liquid outlet opening on the sprayer housing, and a liquid discharge passage extending through the sprayer housing communicating the liquid outlet opening with the pump chamber;

the pump chamber having a cylindrical interior surface and a cylindrical exterior surface and a center axis that defines mutually perpendicular axial and radial directions relative to the trigger sprayer;

a pump piston mounted in the pump chamber for reciprocating movement between charge and discharge positions of the pump piston in the pump chamber;

a trigger mounted on the sprayer housing for movement of the trigger relative to the sprayer housing;

a piston rod projecting from the pump piston to the trigger; and, a spring having a curved length with opposite forward and rearward ends, the spring rearward end engaging over the pump chamber exterior surface, and the spring length extending from the spring rearward end adjacent the pump chamber exterior surface through a bent portion of the spring length to the spring forward end positioned between the pump chamber and the trigger, and the spring having an opening in the spring forward end and the piston rod projecting from the pump piston and through the spring forward end opening to the trigger.

16. The trigger sprayer of claim 15, further comprising:

the spring rearward end having a curved surface that engages against the cylindrical exterior surface of the pump chamber.

17. The trigger sprayer of claim 15, further comprising:

the spring rearward end having an axial surface that engages axially across the cylindrical exterior surface of the pump chamber.

18. The trigger sprayer of claim 15, further comprising:

the piston rod having a length with opposite forward and rearward ends, the piston rod rearward end being connected to the pump piston and the piston rod length extending from the pump piston to the piston rod forward end positioned in the spring opening, and the piston rod forward end having a snap connection with the spring forward end at the spring opening.

19. The trigger sprayer of claim 18, further comprising:

the piston rod forward end extending through the spring opening and engaging with the trigger.

20. The trigger sprayer of claim 19, further comprising:

the piston rod forward end engaging with the trigger on an opposite side of the opening in the spring forward end from the pump piston.

21. The trigger sprayer of claim 15, further comprising:

the piston rod forward end engages with the trigger.

22. The trigger sprayer of claim 15, further comprising:

the piston rod forward end has a portion having a first circumferential dimension that extends through the spring opening and a portion having a second circumferential dimension that is positioned on an opposite side of the spring opening from the pump piston, and the second circumferential dimension is larger than the first circumferential dimension.

23. The trigger sprayer of claim 15, further comprising:

the piston rod forward end being compressible to enable insertion of the piston rod forward end through the spring opening.

24. The trigger sprayer of claim 15, further comprising:

the piston rod forward end having a groove that extends into the piston rod forward end and enables the piston rod forward end to compress as the piston rod forward end is inserted through the spring opening.

25. A manually operated trigger sprayer comprising:

a sprayer housing having a pump chamber in the sprayer housing, a liquid inlet opening on the sprayer housing, a liquid supply passage extending through the sprayer housing communicating the liquid inlet opening with the pump chamber, a liquid outlet opening on the sprayer housing, and a liquid discharge passage extending through the sprayer housing communicating the liquid outlet opening with the pump chamber; the pump chamber having a cylindrical interior surface and a cylindrical exterior surface, the interior and exterior surfaces having a common center axis that defines mutually perpendicular axial and radial directions relative to the trigger sprayer;

a pump piston mounted in the pump chamber for axial reciprocating movement between charge and discharge positions of the pump piston in the pump chamber;

a trigger mounted on the sprayer housing for opposite forward and rearward movement of the trigger on the sprayer housing where forward movement moves the trigger away from the pump chamber and rearward movement moves the trigger toward the pump chamber;

a piston rod extending axially from the pump piston to the trigger;

a spring having a length with opposite forward and rearward ends that are operatively connected between the trigger and the sprayer housing respectively, the spring length including a straight bar extending axially from the spring rearward end across the pump chamber exterior surface and then extending axially from the straight bar through a bend in an intermediate portion of the spring between the spring forward and rearward ends, where the bend in the spring urges the forward movement of the trigger on the sprayer housing, the spring forward end having a flange with an opening, and, the piston rod having a length with opposite forward and rearward ends, the piston rod rearward end being connected to the pump piston and the piston rod length extends axially from the pump piston to the piston rod forward end in the spring flange opening.

26. The trigger sprayer of claim 25, wherein:

a flange projects from the trigger and is positioned on the trigger to engage with the sprayer housing during forward movement of the trigger and prevent further forward movement of the trigger.

27. The trigger sprayer of claim 25, further comprising:

the piston rod forward end extends through the spring flange opening and engages with the trigger.

28. The trigger sprayer of claim 27, further comprising:

the piston rod forward end having a portion with a first circumferential dimension that extends through the spring flange opening and having a portion with a second circumferential dimension that is positioned on an axially opposite side of the spring flange opening from the pump piston, the second circumferential dimension being larger than the first circumferential dimension.

29. The trigger sprayer of claim 27, further comprising:

the piston rod forward end being compressible enabling insertion of the piston rod forward end through the spring flange opening.

30. The trigger sprayer of claim 29, further comprising:

the piston rod forward end having a groove that extends into the piston rod forward end and enables the piston rod forward end to compress as the piston rod forward end is inserted through the spring flange opening.

31. The trigger sprayer of claim 25, further comprising:

the spring straight bar having an axial surface that engages across the pump chamber exterior surface.

32. The trigger sprayer of claim 25, further comprising:

the spring rearward end having a curved surface that engages across the pump chamber exterior surface.

33. A manually operated trigger sprayer comprising:

a sprayer housing having a pump chamber in the sprayer housing, a liquid inlet opening on the sprayer housing, a liquid supply passage extending through the sprayer housing communicating the liquid inlet opening with the pump chamber, a liquid outlet opening on the sprayer housing, and a liquid discharge passage extending through the sprayer housing communicating the liquid outlet opening with the pump chamber;

the pump chamber having a cylindrical interior surface and a cylindrical exterior surface and a center axis that defines mutually perpendicular axial and radial directions relative to the trigger sprayer;

a pump piston mounted in the pump chamber for reciprocating movement between charge and discharge positions of the pump piston in the pump chamber;

a trigger mounted on the sprayer housing for movement of the trigger relative to the sprayer housing;

a piston rod projecting from the pump piston to the trigger, wherein the piston rod comprises a piston rod front portion; and a pair of springs with each spring of the pair being formed as a pair of curved leaves that are separate from each other, each spring having a length with opposite forward and rearward ends with the leaves of each spring being connected at the opposite forward and rearward ends, the spring rearward ends engaging the pump chamber exterior surface, and the spring lengths extending from the spring rearward ends along the pump chamber exterior surface to the spring forward ends positioned between the pump chamber and the trigger and connected by a panel comprising a panel opening, wherein the piston rod front portion passes through the panel opening.

34. The trigger sprayer of claim 33, further comprising:

a bar connected between the spring rearward ends, the bar having a curved surface that engages against the cylindrical exterior surface of the pump chamber.

35. The trigger sprayer of claim 33, further comprising:

the spring rearward ends being formed as a pair of parallel straight bars each having an axial surface that engages axially across the cylindrical exterior surface of the pump chamber.

* * * * *